US008578531B2

(12) United States Patent
Abernathey et al.

(10) Patent No.: US 8,578,531 B2
(45) Date of Patent: Nov. 12, 2013

(54) ASSIST HANDLE ASSEMBLIES AND BEDS WITH AN ASSIST HANDLE ASSEMBLY

(75) Inventors: Ethan S. Abernathey, Chicago, IL (US); Vishwanath A. Bhave, Mundelein, IL (US)

(73) Assignee: Medline Industries, Inc., Mundelein, IL (US)

( * ) Notice: Subject to any disclaimer, the term of this patent is extended or adjusted under 35 U.S.C. 154(b) by 615 days.

(21) Appl. No.: 12/698,705

(22) Filed: Feb. 2, 2010

(65) Prior Publication Data

US 2011/0185507 A1 Aug. 4, 2011

(51) Int. Cl.

| | |
|---|---|
| ***A47C 27/08*** | (2006.01) |
| ***A47C 21/08*** | (2006.01) |
| ***A47C 31/00*** | (2006.01) |

(52) U.S. Cl.

USPC ..... 5/662; 5/424; 5/425; 5/426; 5/428; 5/430

(58) Field of Classification Search

USPC ..... 5/424–430, 662

See application file for complete search history.

(56) References Cited

U.S. PATENT DOCUMENTS

| | | | | |
|---|---|---|---|---|
| 2,817,855 | A * | 12/1957 | Pratt | 5/430 |
| 3,585,659 | A * | 6/1971 | Burst et al. | 5/430 |
| 3,930,273 | A * | 1/1976 | Stern | 5/430 |
| 3,971,083 | A * | 7/1976 | Peterson | 5/430 |
| 4,747,171 | A * | 5/1988 | Einsele et al. | 5/425 |
| 4,993,089 | A | 2/1991 | Solomon et al. | |
| 5,381,571 | A | 1/1995 | Gabhart | |
| 5,388,294 | A * | 2/1995 | Reeder | 5/600 |
| 5,400,450 | A * | 3/1995 | Leoutsakos | 5/662 |
| 5,678,267 | A | 10/1997 | Kinder | |
| 6,058,531 | A | 5/2000 | Carroll | |
| 6,351,861 | B1 * | 3/2002 | Shows et al. | 5/618 |
| 6,397,416 | B2 * | 6/2002 | Brooke et al. | 5/662 |
| 7,003,820 | B1 * | 2/2006 | Iura et al. | 5/83.1 |
| 7,039,971 | B2 | 5/2006 | Sebastien | |
| 7,073,219 | B2 * | 7/2006 | Poulin et al. | 5/425 |
| 7,150,058 | B2 | 12/2006 | Rabska et al. | |
| 7,234,182 | B2 * | 6/2007 | Miller et al. | 5/662 |

* cited by examiner

*Primary Examiner* — William Kelleher
*Assistant Examiner* — Eric Kurilla
(74) *Attorney, Agent, or Firm* — Nixon Peabody LLP

(57) ABSTRACT

Assist handle assemblies and beds with an assist handle assembly are presented herein. In one embodiment, an assist handle assembly includes a mounting frame for attaching to a support platform. A first support arm is pivotably attached to the mounting frame to rotate about a first axis. A second support arm is pivotably attached to the mounting frame to rotate about a second axis, which is different from the first axis. The first and second support arms remain substantially parallel while rotating about respective axes between various positions. In another embodiment, a bed assembly includes a bed frame with a mounting frame attached thereto. First and second support arms are pivotably attached to the mounting frame at first and second locations, respectively, to rotate between raised and lowered positions. A handle with an arcuate body is pivotably attached to the first and second support arms, maintaining a constant concave-down orientation.

19 Claims, 2 Drawing Sheets

ASSIST HANDLE ASSEMBLIES AND BEDS WITH AN ASSIST HANDLE ASSEMBLY

FIELD OF THE INVENTION

The present invention relates generally to assist handles, and more particularly to beds, such as hospital beds, long-term care beds, nursing home beds, invalid beds, and the like, with an assist handle for aiding in the maneuvering about, ingress to, and egress from a bed.

BACKGROUND

Many hospitals, nursing homes, and other patient care facilities provide assist handles and/or guard rails on a variety of patient-supporting platforms, such as patient beds, stretchers, examination tables, and the like. Assist handles are typically associated with beds to aid users, such as the elderly or infirm, in entering and exiting the bed, as well as maneuvering around the bed. Some assist handles also function as guard-rails to prevent the bed occupant from inadvertently falling out of the bed.

Early designs used a rigid frame member, typically in the nature of aluminum or steel tubing, that was bolted or welded directly to the bed frame. While these devices serve the general purpose for which they are intended, such designs hinder access to the bed occupant making it difficult to assist or treat the occupant. In addition, some bed occupants react adversely to side rails because of their restrictive appearance. Permanent-fixture designs also cause considerable difficulty during the changing of sheets and blankets on the bed.

Subsequent improvements include side rails and assist bars that are removably mounted or clamped to the side of the bed frame. One particular design comprises a single-piece tubular side-rail with U-shaped brackets that allow the side-rail to be lifted off the bed frame to free up movement of the occupant to and from the bed. In alternative designs, clamps are substituted for the brackets to provide a sturdier interface. Unfortunately, for the elderly or infirm, neither of these designs is practical as the rail is often too heavy and too cumbersome to be easily attached to and removed from the bed frame.

Accordingly, retractable bedrail and assist bar devices were developed so that the device could be easily stowed in order to render the top surface of the bed more easily accessible. Various constructions provide movable rails and handles that rotate around a single axis between a raised position, in which the rail/handle extends vertically above the surface of the bed mattress, and a lowered position, in which the rail/handle is stowed at a distal end of the bed or lowered to a position below the mattress.

BRIEF DESCRIPTION OF THE DRAWINGS

Various advantages of the invention will become apparent upon reading the following detailed description and upon reference to the drawings.

Figure 1A:
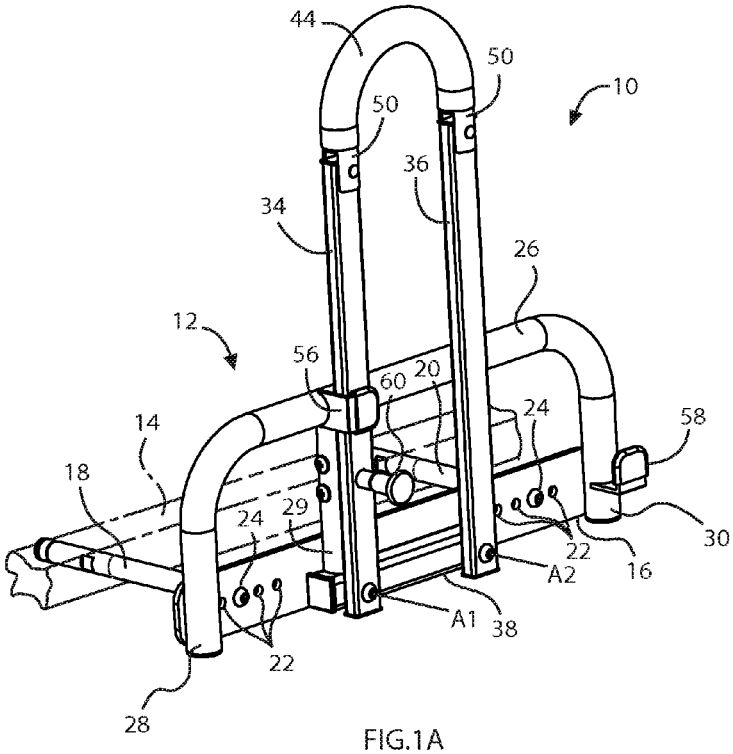
FIG. 1A is a perspective-view illustration of an assist handle assembly in accordance with one exemplary embodiment of the present invention, showing the assist handle in a raised position.

While the invention is susceptible to various modifications and alternative forms, specific embodiments are shown by way of example in the drawings and will be described in detail herein. It should be understood, however, that the invention is not intended to be limited to the particular forms disclosed. Rather, the invention is to cover all modifications, equivalents, and alternatives falling within the spirit and scope of the invention.

DESCRIPTION OF ILLUSTRATIVE EMBODIMENTS

While this invention is susceptible of embodiment in many different forms, there is shown in the drawings and will herein be described in detail representative embodiments of the invention with the understanding that the present disclosure is to be considered as an exemplification of the principles of the invention and is not intended to limit the broad aspect of the invention to the embodiments illustrated. To that extent, elements and limitations that are disclosed, for example, in the Figures, Abstract, and Description of the Illustrative Embodiments, but not explicitly set forth in the claims, should not be incorporated into the claims, singly or collectively, by implication, inference or otherwise.

The present invention will be described herein in the context of an assist handle assembly for aiding in the maneuvering about, ingress to, and egress from a bed used in a health-care facility. However, the present invention is by no means limited to this particular application. By way of example, and not limitation, the concepts of the present invention may just as easily be incorporated into other support platforms, such as examination tables and chairs, hospital beds, nursing home beds, invalid beds, and the like. In addition, the drawings presented herein are not to scale and are provided purely for instructional purposes. As such, absent explicit claim language to the contrary, the individual and relative dimensions and orientations shown in the drawings are not to be considered limiting. Finally, a designation of a constituent part with a numerical preface (e.g., first arm, second arm, third arm, etc.) is provided purely for explanatory purposes and ease of clarification. As such, the use of such designations in the claims is not intended as limiting and therefore does not limit that particular element to the corresponding element in the specification or drawings utilizing the same numerical preface.

Figure 1B:
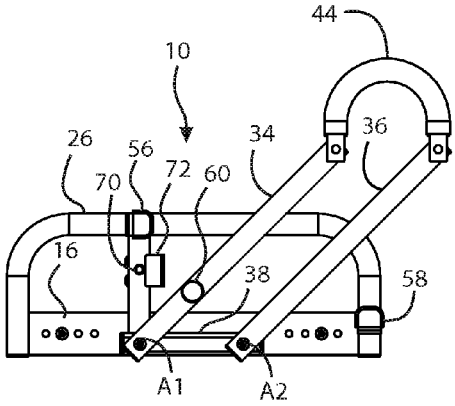
FIG. 1B is a front-view illustration of the assist handle assembly of FIG. 1A, showing the assist handle in an intermediate position.
Figure 1C:
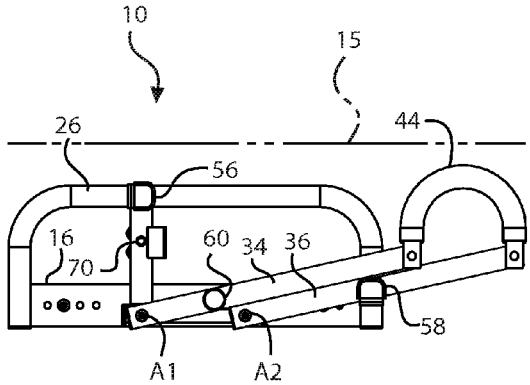
FIG. 1C is a front-view illustration of the assist handle assembly of FIG. 1A, showing the assist handle in a lowered position.

Referring to the drawings, wherein like reference numerals refer to like components throughout the several views, FIG. 1 is a front perspective-view illustration of an exemplary assist handle assembly, designated generally as 10, in accordance with various aspects of the present invention. The assist handle assembly 10 includes a mounting frame, designated generally as 12, that is configured to attach the assist handle assembly 10 to a support platform, such as a long-term care bed, which is represented in the drawings by a portion of the bed frame, (shown in FIG. 1A in phantom at 14) and a portion of the bed mattress (shown in FIG. 1C in phantom at 15). In the exemplary configuration shown, the mounting frame 12 includes a cross plate 16 with first and second adjustable attachment arms 18 and 20, respectively. The first and second adjustable attachment arms 18, 20 are exemplified in the drawings as cylindrical rods that project generally orthogonally from a rear side of the cross plate 16. A distal end of each attachment arm 18, 20 is received in a complementary opening in the bed frame 14, and attached thereto, for example, by c-clips, end caps, bolts, or other fastening means (not shown).

Recognizably, the assist handle assembly 10 can be provided with more or fewer than two attachment arms 18, 20 without departing from the intended scope of the present invention. Moreover, the assist handle assembly 10 can be positioned in multiple ways, for example, at the head or foot of the bed frame 14, and on either side thereof.

One or both of the attachment arms 18, 20 may be selectively repositionable along the mounting frame 12 such that the assist handle assembly 10 can functionally attach to support platforms of varying configurations. In the embodiment shown in FIG. 1, for example, the cross plate 16 is fabricated with a plurality of interface holes 22 spaced along its length. Each of the attachment arms 18, 20 may be selectively positioned so as to coaxially align with a respective one of the interface holes 22 such that a threaded fastener 24 may be passed through the respective interface hole 22 and into a proximal end of the respective attachment arm 18, 20, thereby locking the attachment arm 18, 20 to the cross plate 16. The attachment arms 18, 20 may then be rearranged by removing the fastener 24, repositioning the attachment arm 18, 20 so as to coaxially align with a different interface hole 22, and reengaging the threaded fastener 24 with the proximal end of the attachment arm 18, 20. It should be understood that alternate arrangements may be provided where one or both of the attachment arms 18, 20 are rigidly fastened to or integrally formed with the cross plate 16. To that end, the manner of attaching the assist handle assembly 10 may vary from that shown in the drawings. By way of non-limiting example, the assist handle assembly 10 may be fabricated with clamps or brackets, thereby eliminating the necessity of the attachment arms 18, 20.

Figure 2:
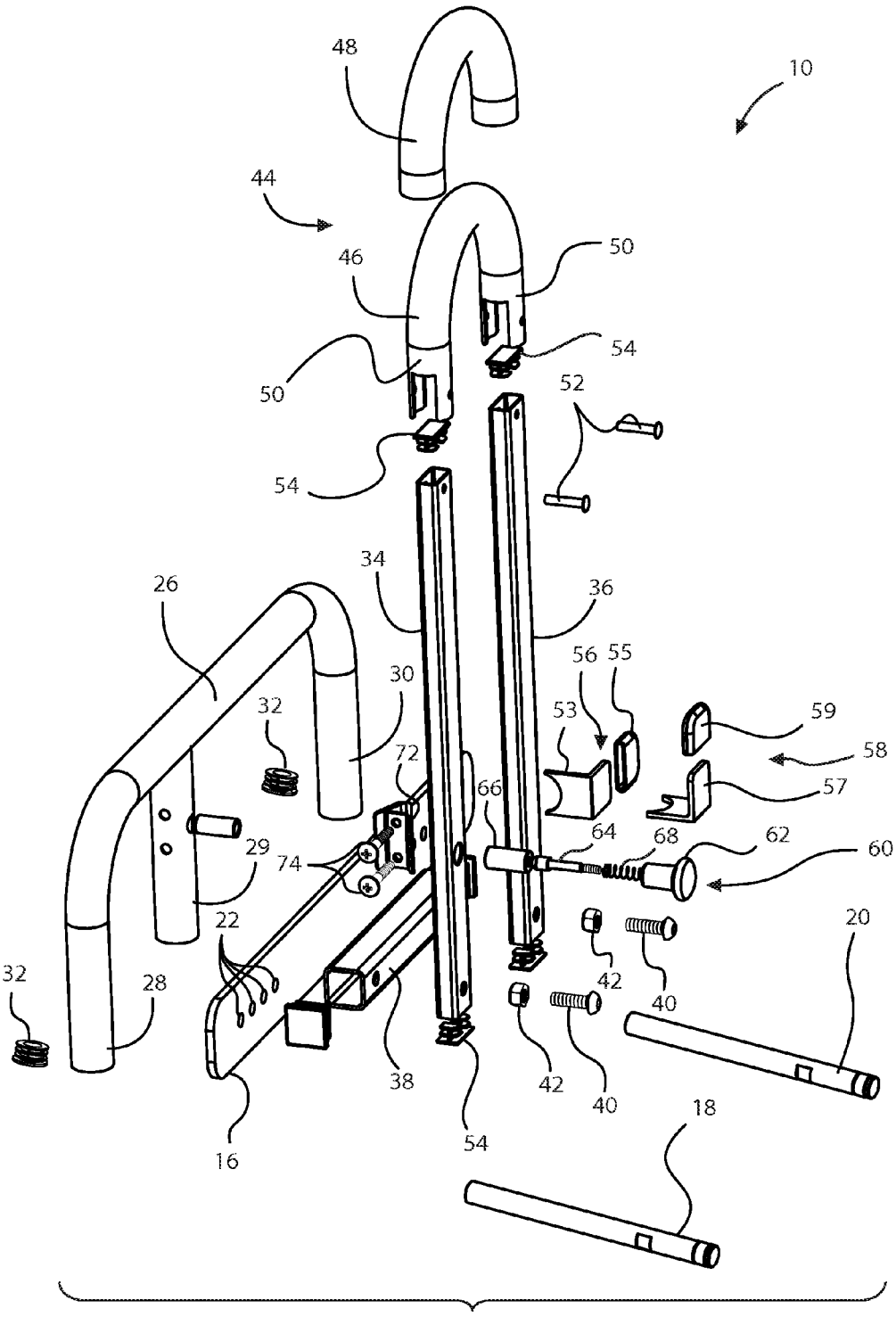
FIG. 2 is an exploded perspective-view illustration of the assist handle assembly of FIGS. 1A-1C.

Referring to both FIGS. 1A and 2, a tubular cross bar 26 extends along the length of the cross plate 16, attaching to an outer face thereof. The cross bar 26 includes three downwardly-projecting support legs 28, 29 and 30, respectively, which attach to the cross plate 16 (e.g., via welds or threaded bolts), buttressing the cross bar 26. The cross bar 26 provides a supplemental assist bar feature for the assist handle assembly 10. Tube plugs, indicated at 32 in FIG. 2, can be inserted into the open ends of each leg 28, 30 for aesthetic and/or safety purposes. The length, height and width of the cross bar 26 can be modified, individually or collectively, depending on the intended application of the assist handle assembly 10. Moreover, the cross bar 26 and support legs 28, 29, 30 may be fabricated as solid bars, and may take on varying geometries.

The assist handle assembly 10 is provided with a pair of collapsible or foldable support arms, namely first and second support arms 34 and 36, respectively. The first and second support arms 34, 36 are exemplified in the drawings as elongated, square tubes with open longitudinal ends. In this instance, end plugs (indicated at 54 in FIG. 2) can be inserted into the open ends of each support arm 34, 36 for aesthetic and/or safety purposes. Optionally, the support arms 34, 36 may be fabricated as solid bars, and may take on varying geometries.

Each of the support arms 34, 36 is pivotably attached to the mounting frame 12 at a different location to rotate or swivel about a distinct axis. According to the exemplary configuration illustrated in FIGS. 1A and 2, a proximal end of the first support arm 34 is pivotably attached to a mounting-frame cross beam 38—e.g., via a bolt 40 and nut 42 (FIG. 2), at a first location to rotate about a first axis A1 (FIG. 1A). In comparison, the proximal end of the second support arm 36 is pivotably attached to the mounting-frame cross beam 38—e.g., via a bolt 40 and nut 42 (FIG. 2), at a second location, which is different from the attachment location of the first support arm 34. Moreover, the second support arm 36 rotates about a second axis A2 (FIG. 1A), which is different from the first axis A1. In the illustrated embodiment, the support arms 34 and 36 have a common plane of rotation, which is generally parallel to the side of the bed frame 14, as seen in FIG. 1A. Although there are only two support arms 34, 36 depicted and described herein, the assist handle assembly 10 can be provided with additional support arms without departing from the scope and spirit of the present invention.

The support arms 34, 36 pivot about their respective axes A1, A2 from a raised or fully-erect position (depicted in FIG. 1A), through an intermediate or transitionary position (depicted in FIG. 1B), to a lowered or collapsed position (depicted in FIG. 1C). That is, the first support arm 34 pivots about the first axis A1 between the raised position shown in FIG. 1A (also referred to herein as "first position") and the lowered position shown in FIG. 1C (also referred to herein as "second position"). Likewise, the second support arm 36 pivots about the second axis A2 between the raised position shown in FIG. 1A (also referred to herein as "third position") and the lowered position shown in FIG. 1C (also referred to herein as "fourth position"). When in the raised position (first and third positions, respectively), the support arms 34, 36 are spaced apart and substantially vertical (e.g., approximately 90° with respect to the bed frame 14 as seen in FIG. 1A). Contrastingly, when in the lowered position (second and fourth positions, respectively), the first support arm 34 is collapsed on top of the second support arm 36 such that the support arms 34, 36 are touching and generally horizontal (e.g., approximately 12° with respect to the bed frame 14, as seen in FIG. 1C). In the illustrated embodiment, the first and second support arms 34, 36 remain substantially parallel while rotating between the raised and lowered positions, as seen throughout FIGS. 1A-1C. The support arms 34, 36 are illustrated in FIGS. 1A-1C as rotating in a clockwise motion when pivoting from the raised to the lowered position; however, the support arms 34, 36 can just as easily be designed to rotate in a counterclockwise direction from the raised to the lowered position. Moreover, the angular orientation of the support arms 34, 36 with respect to the bed frame 14 when in the raised in lowered positions may be varied from that shown in FIGS. 1A and 1C without departing from the intended scope and spirit of the present invention.

A handle 44 is attached to the distal ends of the support arms 34, 36. The handle 44 illustrated in FIG. 2, for example, comprises a rigid body 46 that is covered by a soft, outer jacket 48, providing an ergonomic, compliant gripping surface for the user. In some embodiments, the handle takes on an arcuate shape, such as the semicircular body 46 illustrated in the drawings, which has been shown to be more aesthetically appealing and ergonomically sound than other comparable shapes. However, other geometric configurations are envisioned for the handle 44, such as, but not limited to, square and ellipsoid geometries. Moreover, the handle 44 can be fabricated as a single-piece, unitary structure, for example, without the outer jacket 48 of FIG. 2.

A first end of the handle 44 is pivotably attached to a first, distal end of the first support arm 34—e.g., via bracket 50 and rivet 52, whereas the second end of the handle 44 is pivotably attached to a first, distal end of the second support arm 36—e.g., via bracket 50 and rivet 52. Through these pivot joints, the handle 44 is able to maintain a concave-down orientation, with the apex of the semicircular body 46 pointing upwards, while the first and second support arms 34, 36 pivot back-and-forth between respective raised (FIG. 1A) and lowered (FIG. 1C) positions. In so doing, a user of the assist handle assembly 10 can utilize the handle 44 for maneuvering about, entering, and exiting the bed 14, regardless of the position of the support arms 34, 36. When the support arms 34, 36 are in the raised position, shown in FIG. 1A, the handle 44 extends above the upper surface of the mattress 15, offering the advantages of both an assist bar and a guard rail. In addition, when the support arms 34, 36 are in the lowered position, the handle 44 lies below the upper support surface of the mattress 15, providing unobstructed access to the occupant of the bed (not shown).

The assist handle assembly 10 may be provided with one or more rotation stops that limit the range of rotation (i.e., the arcuate length between respective raised and lowered positions) of the first and second support arms 34, 36. By way of non-limiting example, a first rotation stop 56 is attached to or integrally formed with the tubular cross bar 26 of the mounting frame 12. As best seen in FIG. 2, the first rotation stop 56 comprises an L-shaped flange 53 with its distal tip covered by a soft end cap 55. As shown in FIG. 1A, the first rotation stop 56 projects transversely outward from the tubular cross bar 26, obstructing the rotational path of the first support arm 34. As the assist handle assembly 10 is transitioned toward the fully-erect position shown in FIG. 1A (e.g., in a counterclockwise motion), the first support arm 34 will be pushed into the first rotation stop 56, whereby the stop 56 restricts the first support arm 34 (and, thus, the second support arm 36 via the mechanical interface through the handle 44) from rotating past the raised position. Also, with the L-shaped configuration of the rotation stop 56, the first support arm 34 is constrained from being pushed or pulled outward/away from the bed.

Continuing with the above example, a second rotation stop 58 is attached to or integrally formed with the cross-bar leg 30 of the mounting frame 12. As best seen in FIG. 2, the second rotation stop 58 comprises an L-shaped flange 57 with its distal tip covered by a soft end cap 59. As shown in FIG. 1C, the second rotation stop 58 projects transversely outward from a lower portion of the cross-bar leg 30, obstructing the rotational path of the second support arm 36. As the assist handle assembly 10 is transitioned toward the collapsed position shown in FIG. 1C, the second support arm 36 will be pushed into the second rotation stop 58, whereby the stop 58 restricts the second support arm 36 (and, thus, the first support arm 34 via the mechanical interface through the handle 44) from rotating past the lowered position. Also, with the L-shaped configuration of the rotation stop 58, the second support arm 36 is constrained from being pushed or pulled outward/away from the bed A locking device may be provided to securely fasten the assist handle assembly 10 in the raised and/or lowered positions. In one exemplary configuration, a locking pin 60 is attached to one of the support arms 34, 36, and configured to engage the mounting frame 12 to thereby retain the support arms 34, 36 in a predetermined position or orientation. In FIGS. 1A-1C, for example, the locking pin 60 is operatively attached to the first support arm 34. According to the embodiment of FIG. 2, the locking pin 60 comprises a pull knob 62 that is fixed to a pin 64 (e.g., via mating helical threads), which is biased against a jointing sleeve 66, for example, by compression spring 68. A lock slot 70 is formed in the middle cross-bar leg 29. The lock slot 70 has a complementary shape and size to receive therein the head of pin 64. By feeding the pin 64 into the lock slot 70, the first support arm 34 (and, thus, the second support arm 36 via the mechanical interface through the handle 44) is secured in the raised position, as shown in FIG. 1A. In contrast, extracting the pin 64 from the lock slot 70 allows for free rotation of the assist handle assembly 10.

The locking pin 60 is selectively movable between an engaged position, whereat the pin 64 protrudes a predetermined distance from an inner surface of the first support arm 34 such that the locking pin 60 can be received inside the lock slot 70 of the mounting frame 12, and a disengaged position, whereat the pin 64 is sufficiently retracted such that the locking pin 60 is displaced from the lock slot 70 of the mounting frame 12. The locking pin 60 may be provided with a biasing member, such as compression spring 68, which biases the pin 64 into the engaged position. Moreover, a ramped surface 72 may be attached to (e.g., via cross screws 74 of FIG. 2) or integrally formed with the mounting frame 12, such as the middle cross-bar leg 29. When the locking pin 60 is passed along the ramped surface 72 (e.g., from right to left in FIGS. 1A-1C), the ramped surface 72 presses or urges the pin 64 into the disengaged position. This ramp feature allows a user to raise and lock the assist handle assembly 10 in the fully-erect position of FIG. 1A with one hand. By way of clarification, the user need only grab the handle 44 and rotate the assembly 10 toward the raised position (e.g., counterclockwise with respect to FIGS. 1A-1C). As the first support arm 34 glides towards the middle cross-bar leg 29, the pin 64 is guided into place via the ramped surface 72 and, when the pin 64 is coaxially aligned with the lock slot 70, the locking pin 60 is automatically moved into the engaged position via the compression spring 68. The user is thus not required to manipulate the locking pin 60 to secure the assist handle assembly 10 in the raised position. The assist handle assembly 10 may then be released from its locked position merely by pulling on the pull knob 62 until the pin 64 is sufficiently retracted such that the locking pin 60 is displaced from the lock slot 70 of the mounting frame 12, and thereafter shifting it from the raised position.

Exemplary Alternate Embodiments

The following exemplary embodiments of the invention are not intended to represent each embodiment, or every aspect, of the present invention. The above features and advantages, and other features and advantages of the present invention, will become more readily apparent from the following examples.

According to one embodiment of the present invention, an assist handle assembly for a support platform is provided. The assist handle assembly includes a mounting frame configured to attach to the support platform. A first support arm is pivotably attached to the mounting frame to rotate about a first axis. The first support arm rotates between a first position and a second position. A second support arm is pivotably attached to the mounting frame to rotate about a second axis, which is different from the first axis. The second support arm rotates between a third position and a fourth position. The first and second support arms remain substantially parallel while rotating between respective positions.

In accordance with one optional facet of the present invention, the assist handle assembly also includes a handle that attaches a first end of the first support arm to a first end of the second support arm. The handle may comprise an arcuate body which is configured to maintain a concave-down orientation while the first and second support arms pivot between respective positions. In one exemplary configuration, a first end of the handle is pivotably attached to the first end of the first support arm, whereas a second end of the handle is pivotably attached to the first end of the second support arm.

In accordance with another optional facet, the handle extends above the upper support surface of the support platform when the first and second support arms are in the first and third positions, respectively. In contrast, the handle lies below the upper support surface of the support platform when the first and second support arms are in the second and fourth positions, respectively.

As part of another optional facet of the present invention, the assist handle assembly includes at least one rotation stop attached to the mounting frame. Each rotation stop is configured to obstruct the rotational path of at least one of the first and second support arms.

According to yet another aspect, the assist handle assembly includes one or more adjustable attachment arms. Each adjustable attachment arm is configured to connect the mounting frame to the support platform. The adjustable attachment arm is selectively repositionable along the mounting frame to attach to support platforms of varying configurations.

As part of yet another aspect of the present invention, the assist handle assembly includes a locking pin. The locking pin is attached to the first (or second) support arm, and is configured to engage the mounting frame and thereby retain the first (and/or second) support arm in the first (or third) position. In one optional configuration, the locking pin is movable between an engaged position and a disengaged position. This locking pin may include a biasing member that biases the locking pin into the engaged position. In addition, the mounting frame may include a ramped surface that is configured to urge the locking pin into the disengaged position.

In accordance with another optional facet, the first support arm collapses on top of the second support arm when transitioning from the first position to the second position. Optionally, the first and second support arms are substantially vertical when in the first and third positions, respectively, and generally horizontal when in the second and fourth positions, respectively.

According to another embodiment of the present invention, a bed assembly is presented. The bed assembly includes a bed frame with a mounting frame attached thereto. A first support arm is pivotably attached to the mounting frame at a first location. The first support arm rotates about a first axis between raised and lowered positions. A second support arm is pivotably attached to the mounting frame at a second location. The second support arm rotates about a second axis between raised position and lowered positions. A handle is attached to the first and second support arms. The first and second support arms remain substantially parallel while pivoting between respective raised and lowered positions.

According to one optional facet, the handle comprises a semicircular body with a first end thereof pivotably attached to a first end of the first support arm and a second end thereof pivotably attached to a first end of the second support arm such that the handle maintains a concave-down orientation when the first and second support arms pivot between respective raised and lowered positions.

According to another optional facet, the bed assembly includes first and second rotation stops. The first rotation stop is attached to the mounting frame at a first location, obstructing the first support arm from rotating past the raised position. The second rotation stop, on the other hand, is attached to the mounting frame at a second location, obstructing the second support arm from rotating past the lowered position.

According to yet another optional facet, the bed assembly includes a locking pin that is attached to the first or the second support arm. The locking pin engages the mounting frame and thereby retains the first and second support arms in their respective raised positions. In one exemplary configuration, the locking pin is movable between an engaged position, whereat the locking pin is engageable with the mounting frame, and a disengaged position, whereat the locking pin is not engageable with the mounting frame. The locking pin may include a biasing member that biases the locking pin into the engaged position. The mounting frame may include an optional ramped surface configured to urge the locking pin into the disengaged position.

According to even yet another optional facet, the first and second support arms are spaced apart and substantially vertical when in respective raised positions, whereas the first and second support arms are generally horizontal and touching when in respective lowered positions.

In accordance with yet another embodiment of the invention, a long-term care bed assembly is provided. The long-term care bed includes a bed frame and an assist handle assembly. The assist handle assembly includes a mounting frame that is attached to the bed frame. A first support arm is pivotably attached to the mounting frame at a first location to rotate about a first axis between raised and lowered positions. Likewise, a second support arm is pivotably attached to the mounting frame at a second location to rotate about a second axis between raised and lowered positions. The long-term care bed assembly also includes a handle with an arcuate body. A first end of the handle body is pivotably attached to a first end of the first support arm and a second end of the handle body is pivotably attached to a first end of the second support arm such that the handle maintains a concave-down orientation while the first and second support arms pivot between respective raised and lowered positions.

While the best modes for carrying out the present invention have been described in detail, those familiar with the art to which this invention relates will recognize various alternative designs and embodiments for practicing the invention within the scope of the appended claims.

What is claimed is:

1. An assist handle assembly for a support platform, the assist handle assembly comprising: a mounting frame configured to attach to the support platform; a first support arm pivotably attached to the mounting frame to rotate about a first axis between a first position and a second position; a second support arm pivotably attached to the mounting frame to rotate about a second axis different from the first axis between a third position and a fourth position; and a semicircular handle attaching a first end of the first support arm to a first end of the second support arm, wherein the first and second support arms remain substantially parallel while rotating between respective positions, wherein the semicircular handle is configured to maintain a concave-down orientation while the first and second support arms pivot between respective positions.

2. The assist handle assembly of claim 1, further comprising:

a pair of stops each configured to limit rotational and lateral movement of the semicircular handle.

3. The assist handle assembly of claim 1, wherein a first end of the semicircular handle is pivotably attached to the first end of the first support arm, and a second end of the semicircular handle is pivotably attached to the first end of the second support arm.

4. The assist handle assembly of claim 1, wherein the semicircular handle extends above an upper support surface of the support platform when the first and second support arms are in the first and third positions, respectively, and wherein the semicircular handle lies below the upper support surface of the support platform when the first and second support arms are in the second and fourth positions, respectively.

5. The assist handle assembly of claim 1, further comprising:

at least one rotation stop attached to the mounting frame and configured to obstruct a rotational path of at least one of the first and second support arms.

6. The assist handle assembly of claim 1, further comprising:

at least one adjustable attachment arm configured to connect the mounting frame to the support platform, the at least one adjustable attachment arm being selectively repositionable along the mounting frame.

7. The assist handle assembly of claim 1, further comprising:

a locking pin attached to at least one of the first and second support arms, the locking pin being configured to engage the mounting frame and thereby retain the first and second support arms in the first and third positions, respectively.

8. The assist handle assembly of claim 7, wherein the locking pin is movable between an engaged position and a disengaged position, the locking pin including a biasing member biasing the locking pin into the engaged position, and wherein the mounting frame includes a ramped surface configured to urge the locking pin into the disengaged position.

9. The assist handle assembly of claim 1, wherein the first support arm collapses on top of the second support arm when transitioning from the first position to the second position.

10. The assist handle assembly of claim 1, wherein the first and second support arms are substantially vertical when in the first and third positions, respectively, and generally horizontal when in the second and fourth positions, respectively.

11. A bed assembly comprising:

a bed frame;

a mounting frame attached to the bed frame;

a first support arm pivotably attached to the mounting frame at a first location to rotate about a first axis between a raised position and a lowered position;

a second support arm pivotably attached to the mounting frame at a second location to rotate about a second axis between a raised position and a lowered position; and a handle attached to the first and second support arms, the handle having a semicircular body which maintains a concave-down orientation while the first and second support arms pivot between respective raised and lowered positions, wherein the first and second support arms remain substantially parallel while pivoting between respective raised and lowered positions.

12. The bed assembly of claim 11, wherein the semicircular body has a first end thereof pivotably attached to a first end of the first support arm and a second end thereof pivotably attached to a first end of the second support arm.

13. The bed assembly of claim 11, further comprising:

a first rotation stop attached to the mounting frame at a first location, the first rotation stop obstructing a rotational path of the first support arm to thereby prevent the first and second support arms from rotating past the raised positions; and a second rotation stop attached to the mounting frame at a second location, the second rotation stop obstructing a rotational path of the second support arm to thereby prevent the first and second support arms from rotating past the lowered positions.

14. The bed assembly of claim 11, further comprising:

at least one adjustable attachment arm connecting the mounting frame to the bed frame, the at least one adjustable attachment arm being selectively repositionable at a plurality of locations along the mounting frame.

15. The bed assembly of claim 11, further comprising:

a locking pin attached to at least one of the first and second support arms, the locking pin being configured to engage the mounting frame and thereby retain the first and second support arms in respective raised positions.

16. The bed assembly of claim 15, wherein the locking pin is movable between an engaged position, whereat the locking pin is engageable with the mounting frame, and a disengaged position, whereat the locking pin is not engageable with the mounting frame.

17. The bed assembly of claim 16, wherein the locking pin includes a biasing member biasing the locking pin into the engaged position, and the mounting frame includes a ramped surface configured to urge the locking pin into the disengaged position.

18. The bed assembly of claim 11, wherein the first and second support arms are spaced apart and substantially vertical when in respective raised positions, and wherein the first and second support arms are generally horizontal and touching when in respective lowered positions.

19. A long-term care bed assembly comprising:

a bed frame; and an assist handle assembly, including:

a mounting frame attached to the bed frame;

a first support arm pivotably attached to the mounting frame at a first location to rotate about a first axis between a raised position and a lowered position;

a second support arm pivotably attached to the mounting frame at a second location to rotate about a second axis between a raised position and a lowered position; and a handle having a semicircular body with a first end thereof pivotably attached to a first end of the first support arm and a second end thereof pivotably attached to a first end of the second support arm such that the handle maintains a concave-down orientation while the first and second support arms pivot between respective raised and lowered positions.

* * * * *